US009032680B1

(12) United States Patent
Schmid

(10) Patent No.: US 9,032,680 B1
(45) Date of Patent: May 19, 2015

(54) INSULATED MASONRY MEMBER INSERT CONFIGURED TO COMPENSATE FOR MOLD WEAR

(71) Applicant: Donald T. Schmid, Clarence, NY (US)

(72) Inventor: Donald T. Schmid, Clarence, NY (US)

( * ) Notice: Subject to any disclaimer, the term of this patent is extended or adjusted under 35 U.S.C. 154(b) by 0 days.

(21) Appl. No.: 14/044,672

(22) Filed: Oct. 2, 2013

(51) Int. Cl.
*E04C 1/41* (2006.01)
*E04C 2/288* (2006.01)
*E04B 1/76* (2006.01)

(52) U.S. Cl.
CPC . *E04C 1/41* (2013.01); *E04C 2/288* (2013.01); *E04B 1/7608* (2013.01); *E04B 1/7604* (2013.01)

(58) Field of Classification Search
CPC ..... E04B 1/74; E04B 1/76; E04B 1/7604; E04B 1/7608; E04B 2/08; E04B 2/10; E04B 2/30; E04C 1/40; E04C 1/41; E04C 2/288; E04C 2/296
USPC ..... 52/405.1, 405.3, 406.2, 407.2, 503, 52/561, 570, 571, 396.04, 396.08, 396.09, 52/309.4, 309.8, 309.9, 309.11, 309.12, 52/309.15, 604, 605, 606, 608, 609
See application file for complete search history.

(56) References Cited

U.S. PATENT DOCUMENTS 1,477,258 A * 12/1923 Gilbert ..... 138/115
1,501,709 A * 7/1924 Grueby ..... 52/425
4,551,959 A 11/1985 Schmid
4,856,248 A * 8/1989 Larson et al. ..... 52/405.1
5,066,440 A * 11/1991 Kennedy et al. ..... 264/69
5,209,037 A * 5/1993 Kennedy et al. ..... 52/309.12
5,339,592 A 8/1994 Schmid
5,349,798 A * 9/1994 Gross ..... 52/405.1
5,355,647 A * 10/1994 Johnson et al. ..... 52/503
5,402,609 A * 4/1995 Kelley, Jr. ..... 52/98
5,528,874 A 6/1996 Schmid
5,704,183 A * 1/1998 Woolford ..... 52/604
5,749,191 A * 5/1998 Schmid ..... 52/405.1
6,513,293 B2 * 2/2003 Miller ..... 52/405.1
6,615,561 B2 * 9/2003 MacDonald et al. ..... 52/606
6,722,094 B1 * 4/2004 Judd et al. ..... 52/404.1
7,739,845 B2 * 6/2010 Kennedy ..... 52/405.3
8,091,308 B2 * 1/2012 Westmoreland et al. .... 52/405.4
2006/0101756 A1 * 5/2006 McClure ..... 52/405.1
2008/0104916 A1 * 5/2008 Schmid ..... 52/405.2

* cited by examiner

*Primary Examiner* — Jessica Laux
(74) *Attorney, Agent, or Firm* — James C. Simmons

(57) ABSTRACT

A masonry block which includes two supporting parts and an insulative malleable member for interlockingly and tightly inserting between the supporting parts. The malleable member has a plurality of spaced grooves in at least one portion of each of its supporting part-engaging surfaces which is susceptible to binding. Its supporting part-engaging surfaces comprise otherwise thereover spaced convex surface portions for engaging the supporting part surfaces respectively to accommodate gradual enlargement of the supporting parts due to mold wear. For ease of picking up the block, the malleable member has in its upper surface a pair of spaced transverse hand holds, a centrally positioned longitudinal hand hold, and a pair of thumb holds positioned longitudinally outwardly of said transverse hand holds respectively.

19 Claims, 4 Drawing Sheets

INSULATED MASONRY MEMBER INSERT CONFIGURED TO COMPENSATE FOR MOLD WEAR

The present invention relates generally to masonry blocks. More particularly, the present invention relates to a type of masonry block wherein a malleable member is interlockingly inserted between two supporting parts.

My U.S. Pat. Nos. 4,551,959, 5,339,592, and 5,528,874, which are incorporated herein by reference, disclose concrete masonry members or units wherein a unit is composed of a pair of spaced supportive parts separated from one another by a member composed of insulating material positioned between and substantially filling the space between the supportive parts and extending over the lengths of the supportive parts. The supportive parts have projections alternately over the length so that the space has a serpentine shape. The insulation member is accordingly also formed to have a complementary serpentine shape. The projections have enlarged end portions for interlocking the insulation to the supporting parts.

See also U.S. Pat. No. 5,209,037, which is also incorporated herein by reference and which discloses a building block having a pair of spaced block parts between which a serpentine-shaped insulation member is inserted. FIGS. 26 and 27 thereof show what is referred to as crushed ribs on the insulation member. Where they are located, these crushed ribs extend only partially over the insulation member height for a purpose which does not appear to be stated. These crushed ribs are shown in FIG. 22 thereof as being located only in which may be called tight corners, i.e., on surfaces 272, 274, 276, 278, 280, and 282 in FIG. 22 thereof (see also col. 17, line 61, to col. 18, line 7, thereof). See also U.S. Pat. No. 7,739,845, which is also incorporated herein by reference.

The individual supporting parts as well as the insulating member are formed in molds and are closely dimensioned to achieve the desired tight "fit" therebetween. However, wearing of a supporting part mold over a long-term period of production results in enlarged supporting parts, resulting in diminished space therebetween to receive the malleable member. These imperfections in supporting part sizes may make it difficult to assemble the insulation material to the supporting parts.

My U.S. Pat. No. 5,749,191, which is also incorporated by reference, provides a solution to this mold wear problem by providing spaced rectilinear grooves in the insulating member surfaces for receiving malleable adjacent land portions. The shapes of these grooves are best seen in FIG. 4 thereof, including rectilinear grooves 50 and increased width rectilinear grooves 62 for preventing binding at corners. In order to tighten the masonry unit longitudinally without distorting its width, locating rectilinear land portions 64 and 65 are placed along laterally-extending segments of surfaces 58 and project outwardly from the insulation portion surfaces 58, as illustrated at 66 and 67 (see also col. 3, lines 9 to 65, thereof). In order to equalize forces placed on the masonry unit as well as to provide stackable symmetry, the grooves and lands are placed to provide symmetry both length-wise and width-wise, as further discussed at col. 3, line 66, to col. 4, line 19, thereof.

My U.S. published patent application 2008/0104916, which is also incorporated by reference, provides a similar solution to this mold wear problem by providing alternately rectilinear elevated portions and rectilinear recesses, shown at 150 and 152 respectively in FIG. 5 thereof, around the contact surface thereof, for providing a compression mechanism for the insulating member to compress as the block members become thicker as the molds used to make them wear out (see also page 4, paragraph 0035, thereof).

For picking up the composite blocks, three thumb holds have been provided in a triangular pattern in the malleable member.

While my above solutions have been shown to work well, there is room for further improvement, which I have continued to work on and which I have come up with. It is accordingly an object of the present invention to provide an improved solution to the mold wear problem.

It is another object of the present invention to make it easier to pick up the composite blocks.

In accordance with my improved solution, I have determined that tight areas of the malleable member require a different mechanism for interfitting with the supporting parts than required along portions of the malleable member surface which are relatively straight. In addition, I have determined that convex portions of the malleable member surface work better than rectilinear elevated portions. My improved solution is discussed in greater detail hereinafter.

In order to make it easier to pick up the composite blocks, there is provided in the upper surface of the malleable member a pair of spaced transverse hand holds, a centrally positioned longitudinal hand hold, and a pair of thumb holds positioned longitudinally outwardly of said transverse hand holds respectively.

The above and other objects, features, and advantages of the present invention will be apparent in the following detailed description of the preferred embodiments thereof when read in conjunction with the appended drawings in which the same reference numerals depict the same or similar parts throughout the several views.

DETAILED DESCRIPTION OF THE PREFERRED EMBODIMENT(S)

Figure 1:
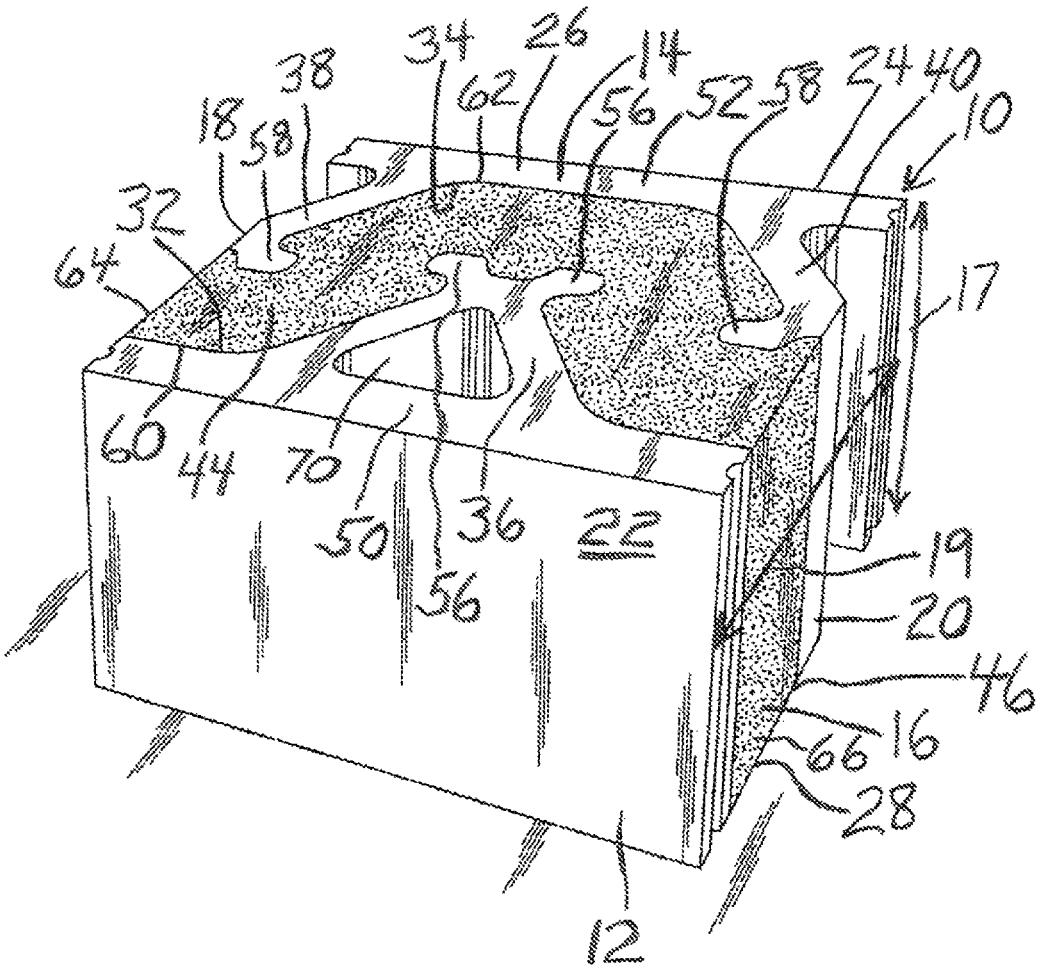
FIG. 1 is a perspective view of a composite concrete masonry block which embodies the present invention.

Referring to FIG. 1, there is shown at 10 a composite masonry block or unit which comprises two outer structurally supporting concrete parts 12 and 14 which are spaced (isolated) from one another by a malleable member 16. The supporting parts and the malleable member cooperate with one another in an interlocking arrangement so that the structural integrity of the composite block is sound, as described in greater detail in my aforesaid patents/published application which are incorporated herein by reference and hereinafter. The term "concrete" is meant to refer herein to any cementitious material or baked clay or other suitable material adapted to support a compressive load such as in the wall of a building. The insulating material may be urea or phenol formaldehyde, expanded polystyrene, phenolic resins, or polyurethane foam, or other suitable malleable material with low thermal transmittance. For example, the insulation material of which the malleable member 16 is composed may desirably be pre-expanded polystyrene foam, having a weight of about 2 pounds per cubic foot. The unit 10 is adapted for use in a wall comprised of like units in which it is desired that the thermal conductivity between opposite sides of the wall be low, as described more fully in my aforesaid patents/published application. The insulation member 16 may also be provided in a composite wall having supporting parts on one side of insulation members 16 and a poured concrete sheet constituting an integral plurality of supporting parts on the other side thereof, as described more fully in my aforesaid patents/published appl.

To assemble the composite block, the supporting parts are positioned to be spaced apart and the insulation member lowered to be received interlockingly between them. The insulation member may be slightly tapered from top to bottom, for example, about 3/16 inch (such as, more precisely, about 0.173 inch) on each side, to provide a close fit, as described more fully in my aforesaid patents/published application.

The composite block 10 has opposite parallel and planar end walls 18 and 20, opposite parallel and planar sidewalls 22 and 24, and parallel and planar top and bottom walls 26 and 28 respectively. The sidewalls 22 and 24 are substantially perpendicular to the top and bottom walls 26 and 28 respectively and the end walls 18 and 20, and the top and bottom walls 26 and 28 respectively are substantially perpendicular to the end walls 18 and 20. One supporting part 12 defines one sidewall 22, and the other supporting part 14 defines the other sidewall 24.

The supporting parts 12 and 14 have, opposite their respective sidewalls 22 and 24, surfaces 32 and 34 respectively which engage the insulation member 16. These surfaces 32 and 34 extend over the height and length of the block 10 and are inwardly (between the sidewalls 22 and 24) of the assembled composite block 10.

Figure 2:
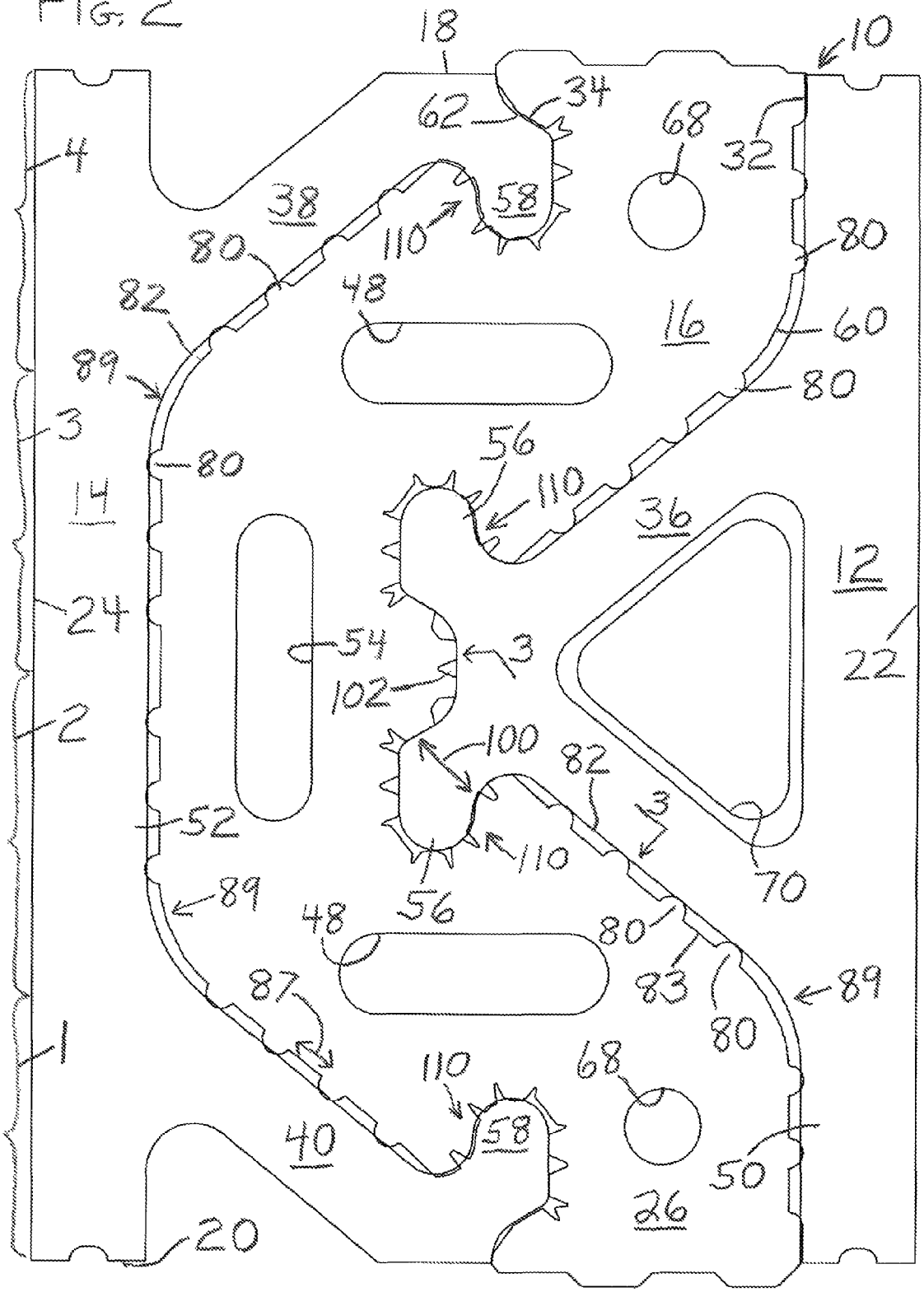
FIG. 2 is an enlarged plan view thereof.

The insulation member 16 has the same taper as the interior surfaces of the supporting parts have and is of generally uniform thickness over its height, illustrated at 17, i.e., extending uniformly entirely over the distance between the top and bottom walls 26 and 28 respectively, and has generally a serpentine shape, as viewed in the plan view of FIG. 2, i.e., the view of the upper wall 26, as seen in FIG. 1. The supporting parts 12 and 14 respectively have generally uniform thickness outer portions 50 and 52 (from which projections emanate, as discussed hereinafter) extending over the entirety of their lengths, which define the sidewalls 22 and 24 respectively. The inner surfaces 32 and 34 of the supporting parts 12 and 14 respectively are defined in part by a plurality of supporting part projections which alternate (between the surfaces 32 and 34) over the composite block length, with a single projection 36 of supporting part 12 between the end projections 38 and 40 of supporting part 14 (or there could be a greater number of such alternating projections), as described more fully in my aforesaid patents/published application. The inner surfaces 32 and 34 are spaced from each other generally uniformly over the lengths thereof thereby defining a serpentine pattern which is complementary to the serpentine-shaped pattern of the insulation member 16 for insertion of the insulation member 16 so that it substantially fills the space between the supporting parts 12 and 14, as described more fully in my aforesaid patents/published application. The insulation portion 16 has surfaces 60 and 62 which define the serpentine shape and which engage the supporting part surfaces 32 and 34 respectively, has upper and lower surfaces 44 and 46 respectively which partially define the top and bottom masonry unit walls 26 and 28 respectively, and also has end surfaces 64 and 66 which partially define the end walls 18 and 20 respectively.

In the particular block 10 shown in the drawings, the projection 36 is generally in a triangular form, wherein the projection 36 tapers inwardly from portion 50 and terminates in a pair of bulbous projections 56 to one side and to the other side respectively, which give the appearance of mouse ears (which may thus be called Mickey's ears). The projections 38 and 40 each extends inwardly (toward the opposite sidewall 22, when the block 10 is assembled) beyond the mouse ears 56 and terminates in a similarly-shaped bulbous projection 58 as the shape of each of Mickey's ears 56.

Previously, I have provided circular thumb holds in a triangular pattern in a composite block malleable member 16 for use in picking up a composite block. In order to better facilitate the handling of the composite block 10, in accordance with the present invention, the distance between two of the thumb holds 68 in the malleable member 16 is increased, the third thumb hold is replaced with a horizontally directed centrally located (between the block ends 18 and 20) elongate hand hold, illustrated at 54, in the malleable member 16, and a pair of longitudinally-spaced transversely directed (between the block edges 22 and 24) elongate hand holds, illustrated at 48, are added in the malleable member 16. Thus, referring to FIG. 2, the pair of hand holds 48 (not shown in FIG. 1) in the insulation member 16 are provided on laterally opposite sides of Mickey's ears 56, extending toward the sidewalls, and centered between the sidewalls for balance when used for picking up the composite block. Each of them is, for example, about 3½ inches long by about 1 inch wide by about 3 inches deep. The third hand hold 54 (not shown in FIG. 1) in the insulation member 16 is centered to extend toward the end walls, again for balance, and centered above Mickey's ears 56. It is, for example, about 4 inches long to allow one's thumb to reach it when the hand is in one of the other hand holds, about 1 inch wide, and about 3 inches deep. The pair of circular thumb holds 68 (also not shown in FIG. 1) in the insulation member 16 are provided on laterally opposite sides near the end walls respectively, and each has, for example, a diameter of about 1⅛ inch and a depth of about 2¼ inches. Thus, the hand holds 48 and 54 and thumb holds 68 are provided to be centrally and symmetrically located to provide balance when the composite block 10 is being picked up. The thumb holds 68 are located, for example, about an inch from the block ends 18 and 20 respectively, the distance between each thumb hold 68 and the adjacent hand holds 48 is, for example, about an inch, and the distance of each of the hand holds 48 and the hand hold 54 is, for example, about an inch to allow a person's hands to easily span between adjacent hand/thumb holds in order to facilitate easy grabbing and picking up of the block 10 with a person's hands. Thus, the hand and thumb holds, as described and illustrated, are provided to provide for the handling of the composite blocks 10 to facilitate laying of them. The exemplary dimensions for the hand and thumb holds as well as exemplary dimensions elsewhere in this specification are for purposes of illustration and not for purposes of limitation. A grout opening, illustrated at 70, is provided in the triangular portion 36 (described hereinafter) of the supporting part 12.

As previously discussed, the hand and thumb holds 48, 54, and 68 are provided to facilitate the handling of the composite blocks 10 while laying them in the assembly of a typical wall. For this purpose, the malleable member 16 must be held tightly between the supporting parts 12 and 14, and this is done as hereinafter described, to allow the block to be held adequately together to permit such handling as well as to provide structural integrity.

For the purposes of the following description, the block 10 may be said over its length to have 4 quadrants, which are labeled 1, 2, 3, and 4 in FIG. 2, quadrants 1 and 2 comprising a first half, and quadrants 3 and 4 comprising a second half. It should be noted that quadrant 1 is a 180 degree polar array of quadrant 2 and that, likewise, quadrant 3 is a 180 degree polar array of quadrant 4. Thus, for quadrants 1 and 2 (and similarly for quadrants 3 and 4), the view of quadrant 2 may be obtained by rotating quadrant 1 in its plane 180 degrees (with the exception that the edge portions (defining the block ends) may be altered as seen to allow appropriate interaction with adjacent blocks. It should also be noted that the first block half (constituting quadrants 1 and 2) is a mirror image of the second block half (constituting quadrants 3 and 4), thus desirably for providing stackable half-bond symmetry (wherein each block is turned around 180 degrees relative to the blocks directly below and off-set by a half block, as opposed to stack bond wherein a block is laid directly on the below block without any offset), which is described more fully in my aforesaid patents/published application. However, the use of stack bonding is meant to come within the scope of the present invention. Accordingly, it should be apparent that the shapes of Mickey's ears 56 and the outer projections 58 in the supporting parts 12 and 14 are identical or at least substantially identical. Thus, hereinafter, a description of one of the four parts 56 and 58 is intended to apply to the others of the parts.

A mold for the malleable member 16 may be composed of aluminum and preferably utilizes the commonly known EDM (electrical discharge machining) process to allow the machining to precisely follow the drawing as it cuts the mold for the member 16.

A foam is desirably sprayed on horizontal and vertical faces of the insulation member 16 in order to seal against convection currents and moisture penetration. The foam is an expanding spray foam such as been used to seal windows and is applied by a foam gun. The foam is preferably an isocyanurate.

For laying a wall, face shell bedding mortar (for example, ⅜ inch) may be applied on the horizontal faces of the block, along edge portions. Head joint mortar (for example, ⅜ inch) may be applied on the vertical faces of the block, along edge portions.

The supporting parts 12 and 14 and malleable member 16 of the composite block 10 may have numerous shapes, the shapes in the drawings being exemplary thereof and not intended for purposes of limitation, it being understood that any of other suitable numerous shapes are meant to come within the scope of the present invention. No matter what the shapes are of the insulation member surfaces 60 and 62, the present invention resides in the means for effecting engagement of the insulation member surfaces 60 and 62 with the respective supporting part surfaces 32 and 34 in a manner for compensating for mold wear and the resulting gradual enlargement over time of the supporting parts 12 and 14, which engagement effecting means will now be described.

While the mold wear solutions provided in my aforesaid patents/published application have been determined to work well, I have determined that rectilinear elevated portions, as in my aforesaid patents/published application, do not offer the best characteristics for adjusting to the gradual enlargement over time of the supporting parts 12 and 14 and that convex portions, preferably semi-cylindrical, of the malleable member surface adjust/wear more easily due to the decreased surface areas at the points of contact with the supporting part surfaces. Accordingly, referring to FIGS. 2 and 3, in accordance with the present invention, spaced convex portions 80 are provided for engaging the supporting part surfaces 32 and 34 respectively over the extent (in the plan view of FIG. 2) of portions, illustrated at 82, of the member surfaces 60 and 62 respectively which are relatively straight or gradually curved and thus result in little likelihood of binding. These convex portions 80 are preferably semi-cylindrical, extending over the height 17 of the member 16. As can be seen, such a more pointed shape of the convex portions 80, with resulting less surface area to contact the supporting part surfaces 32 and 34 respectively, is provided to allow the member 16 to more easily adjust to or accommodate the gradual enlargement over time due to mold wear of the supporting parts 12 and 14.

Between each pair of convex portions 80 is a member surface portion 83 which is suitably flat or otherwise follows the gradual contour at that location of the member surface, but may be otherwise shaped suitably to achieve the desired adjustment to the gradual enlargement over time due to mold wear of the supporting parts 12 and 14.

As discussed more fully in my aforesaid patents/published application (for example, col. 4, lines 20 to 27, of my aforesaid U.S. Pat. No. 5,749,191), the block 10 may typically have a nominal width, illustrated at 19 in FIG. 1, of, for example, about 10 or 12 inches. Its height 17 may be, for example, about 7 to 8 inches, and its length may be, for example, about 15 to 16 inches. The exemplary dimensions hereinafter are with reference to and considered suitable for such a typical block and blocks of substantially the same sizes. The selection of dimensions for blocks of substantially different sizes may be determined using principles which are within the knowledge and skill of one of ordinary skill in the art to which the present invention pertains.

The mold wear may cause the supporting part surfaces to each enlarge by as much as about ⅛ inch over the mold lifetime. To accommodate this enlargement of the supporting parts by being gradually worn down and/or expanded into the adjacent space, illustrated at 86, the depth, illustrated at 84, of each of the convex portions 80 is desirably between about ⅛ inch and about ¼ inch, preferably about 3/16 inch. The distance, illustrated at 87, between convex portions 80 may vary but may typically be, for example, about ½ inch. In locations, such as at 89 (FIG. 2), where there is a gradual change in direction (as compared to more abrupt changes in direction or tight areas, which are hereinafter discussed), this distance 87 may increase to, for example, about ¾ inch to avoid some mild pinching in such locations. Thus, this distance 87, for example, may vary between about ½ and 1¼ inch.

Figure 3:
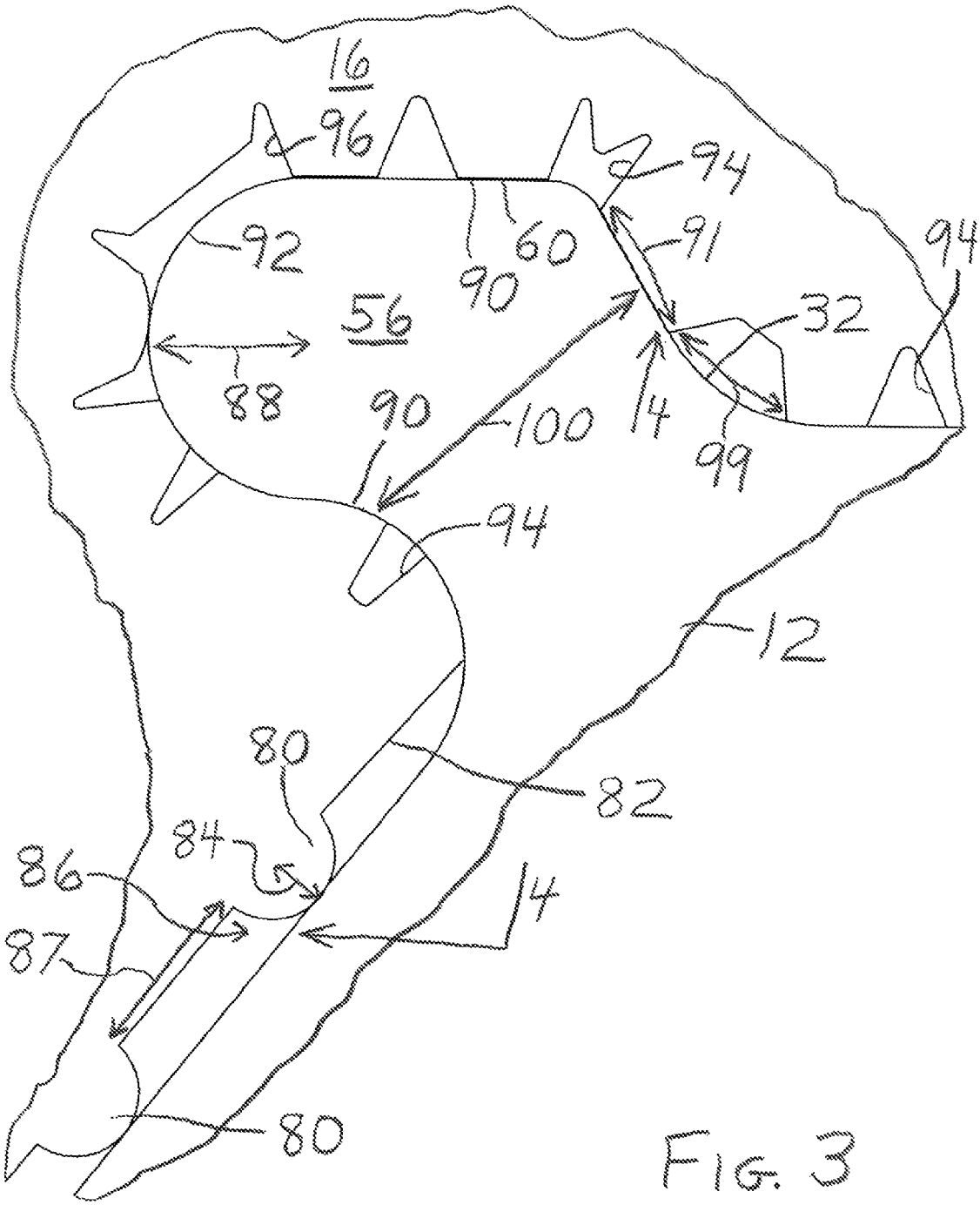
FIG. 3 is a further enlarged plan view of a portion thereof taken along lines 3-3 of FIG. 2.

In areas of tight corners or areas or spaces (having abrupt changes of direction, such as, for example, where a radius of curvature, illustrated at 88, is about ½ inch or less) and/or where a malleable member surface converges closely upon itself, such as, for example, where the distance illustrated at 100 (FIG. 2) is less than about 1 inch, such as Mickey's ears 56 and projections 58, where binding is expected (which may be referred to herein as "tight areas"), the provision of the convex portions may be considered unsuitable due to their not being able to adequately prevent binding, which is likely in such areas. This is distinguished from an area wherein a member surface (in plan view as seen in FIGS. 2 and 3) is generally straight or, as illustrated at 89 (FIG. 2), has more gradual curvature, where binding is not expected and the convex portions would be considered suitable.

In order to prevent such binding in such tight areas where binding is expected, in accordance with the present invention, spaced grooves, illustrated at 94 (FIG. 3), are provided in the surfaces 60 and 62 in the tight areas considered to be susceptible to binding, i.e., around Mickey's ears 56 and projections 58. These grooves 94 are desirably provided to afford room for receiving overflow of adjacent malleable material to provide relief against binding yet still snug the assembly 12, 14, and 16 together, as hereinafter described. These grooves 94 are preferably rectilinear and may be triangular or otherwise suitably shaped, as desired, as illustrated. The grooves 94 have a suitable depth, for example, a depth of about 3/16 inch. Distance, illustrated at 91, between grooves 94 may vary and may, for example, be between about ¼ and ½ inch. The length, illustrated at 99, of a groove 94 may also vary, for example, between about ⅜ inch and ¾ inch. A groove (such as groove 96 at an especially acute part of an area or a more abrupt change of direction) may be longer, for example, about 1¼ inch, than others of the grooves so as to afford greater relief against binding for such a very acute change of direction or bend. It should be noted that in transition areas or areas where one tight area transitions into another tight area (i.e., the transition between Mickey's ears 56), a groove such as groove 102 (FIG. 2) may still be provided even though the radius 88 and distance 100 do not strictly dictate that a groove be provided at such a location. A groove 94 may be provided at an apex of a sharp curve, where binding is considered likely. The key is that the grooves 94 are provided in those areas, especially tight areas, which are considered to be susceptible to binding or subsequently found to in fact bind, and the convex portions 80 are otherwise provided along straight surface portions or in areas less susceptible to binding.

Figure 4:
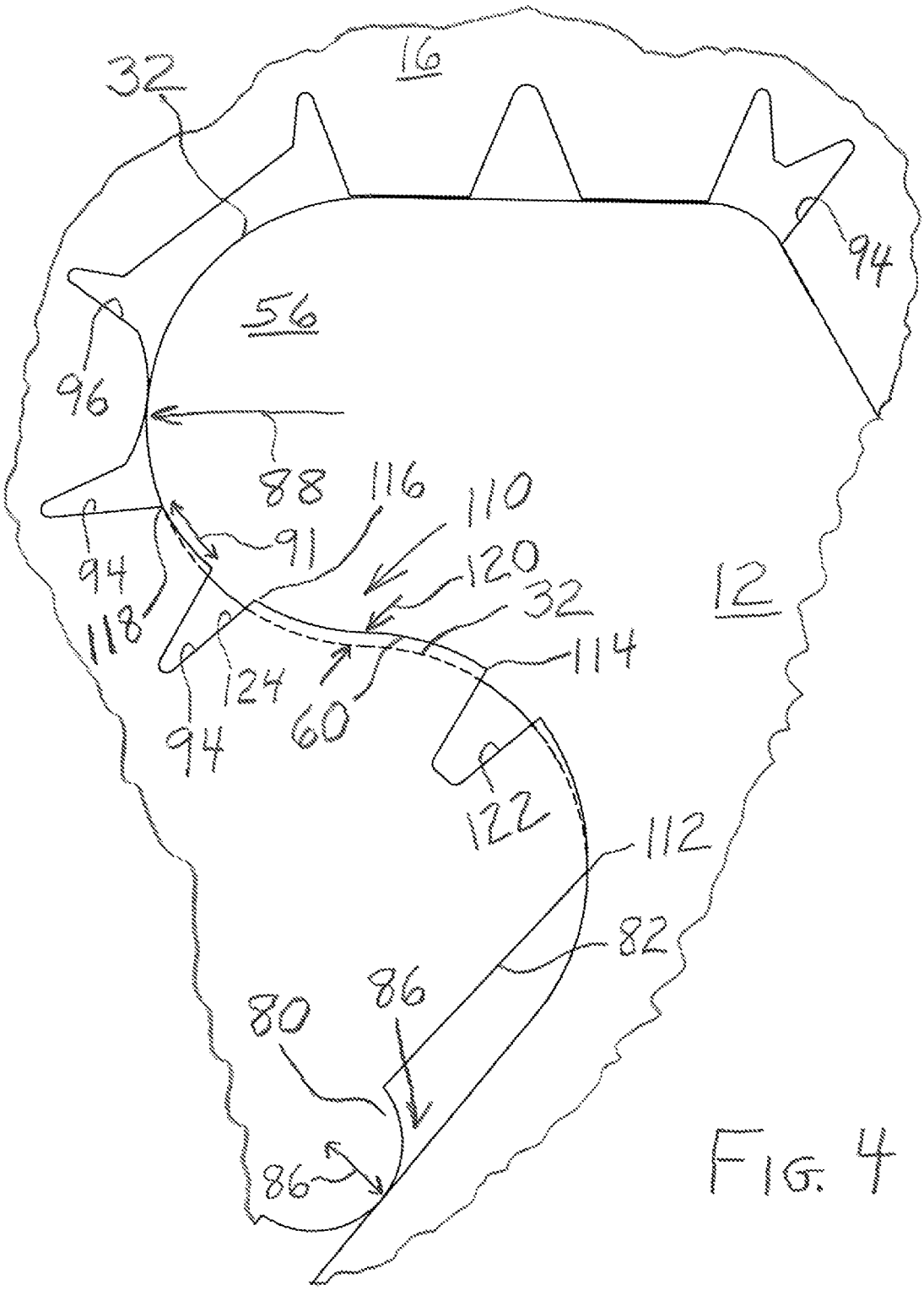
FIG. 4 is an even further enlarged plan view of a portion thereof taken along lines 4-4 of FIG. 3, illustrating an overlap between one of two supporting concrete parts and a malleable member in position relative thereto to be inserted between the two supporting concrete parts to form the composite block.

FIG. 4 illustrates the relationship of the positions of a supporting part 12 and the malleable member 16 prior to insertion of the malleable member 16 between the supporting parts 12 and 14. While illustrated for one of the Mickey's ears 56, it should be understood that a similar relationship exists for the other projections 56 and 58.

The malleable member 16 should be so tightly fitted to the supporting parts 12 and 14 that the composite block 10 can be picked up by picking up the malleable member 16, using the hand holds 48 and 54 and thumb holds 68. In order to provide such a tight fitting, selective strategically located interference fits are provided between the supporting part and malleable member facing surfaces, thus providing four substantially identical interference fits one of which is illustrated (prior to insertion of the malleable member between the supporting parts) at 110 in FIG. 4. As illustrated in FIG. 4, the surface 60 of the malleable member 16 overlaps the surface 32 of supporting part 12 (for each of Mickey's ears 56) to provide two of the desired interference fits 110. Similarly, the opposed surface 62 of the malleable member 16 overlaps the surface 34 of the other supporting part 14 (for each of projections 58) to provide the other two of the desired interference fits 110. It should be noted (see FIG. 2) that the interference fits 110 are strategically located to provide interference force against both supporting parts 12 and 14 so that the fit of the malleable member 16 between the supporting parts 12 and 14 (wherein the malleable member 16 must be "squeezed" into the space between the supporting parts 12 and 14) is provided to be snug and provide the desired tightness and structural integrity so that the composite block 10 can be picked up solely by grasping the appropriate hand holds 48 and 54 and thumb holds 68 and lifting.

Referring again the FIG. 4, the interference fit or overlap 110 is illustrated as beginning at point 112 and gradually increases until point 114 after which the overlap is constant until point 116. Beginning at point 116, the overlap gradually decreases until it ends at point 118. The maximum amount, illustrated at 120, is, for example, 1/32 inch (with the overlap being uniform over the distance between the grooves 122 and 124) to provide a suitably tight interference fit 110 when the malleable member 16 is inserted between the supporting parts 12 and 14 to provide the composite block 10 with the desired structural integrity. It should be understood that there may be alternative locations and embodiments of the interference fits which achieve the desired structural integrity, and such alternative locations and embodiments are meant to come within the scope of the present invention as defined by the claims.

As described and illustrated in my aforesaid published application, the blocks 10 are desirably provided to have near uniform distance longitudinally and transversely between the opposing supporting parts or face shells 12 and 14 thereby to provide a near uniform space to accommodate the near uniform thickness malleable member 16 for ideal heat transfer characteristics, i.e., to eliminate short heat transfer paths, so that the R-value (value of resistance to heat transfer) can be maximized.

What is thus provided by the present invention is the provision of grooves in malleable member surface areas susceptible to binding and the provision otherwise of convex malleable member surface portions to engage the supporting parts so as to best accommodate their gradual enlargement due to mold wear, and the insulated blocks 10 are provided, with the insulation 16 and its being shaped to eliminate short heat transfer paths, to achieve a large increase in total block R-factor from a typical R-factor of 1.45 to an R-factor in the range of about 15 for a typical concrete block wall. Such an insulated concrete block wall, when constructed and sealed with the aforesaid isocyanurate spray-on foam, is provided to have superior moisture and mildew resistance.

It should be understood that, while the present invention has been described in detail herein, the invention can be embodied otherwise without departing from the principles thereof, and such other embodiments are meant to come within the scope of the present invention as defined by the appended claims.

What is claimed is:

1. A malleable member for interlockingly and tightly inserting between two supporting parts to form a masonry block such that surfaces of the member engage surfaces respectively of the supporting parts over a height, wherein each of said member surfaces has a contour which in plan view of the member is defined by a line of contour and consists essentially of over at least a major portion thereof a multitude of spaced curved convex portions each extending over said height and alternating with a multitude of spaced recesses which recesses together define in the plan view a portion of said line of contour extending over said major portion, whereby said curved convex portions in the plan view project from said line of contour so that, when the member is inserted between the supporting parts, only said curved convex portions engage the respective supporting part surface along said respective major surface portion and over said height to thereby accommodate gradual enlargement over time of successive supporting parts due to mold wear.

2. A malleable member according to claim 1 further comprising means for preventing binding of said member.

3. A malleable member according to claim 2 wherein said means for preventing binding comprises at least one other portion of each of said member surfaces which is formed to engage said respective supporting part surface over said height when inserted between the supporting parts and which is susceptible to binding and which has a plurality of spaced grooves therein which extend over said height, whereby the member when inserted between the supporting parts engages the respective supporting part over said respective other surface portion and over said height along said respective line of contour.

4. A malleable member according to claim 1 further comprising at least one other portion of each of said member surfaces which is formed to engage the respective supporting part surface over said height and which has a plurality of spaced grooves therein which extend over said height, whereby the member, when inserted between the supporting parts, engages the respective supporting part over said other surface portion and over said height along said line of contour.

5. A malleable member according to claim 4 wherein said grooves are rectilinear.

6. A malleable member according to claim 1 wherein said curved convex portions have a depth of about 3/16 inch.

7. A malleable member according to claim 1 wherein said curved convex portions are semi-cylindrical.

8. A malleable member according to claim 1 wherein the malleable member is composed of insulation material.

9. A malleable member according to claim 1 wherein the malleable member has an upper surface and contains in said upper surface, when inserted between supporting parts to form a block, a pair of spaced transverse cavities which define hand holds for picking up the block by a person, a centrally positioned longitudinal cavity which defines a hand hold for picking up the block by a person, and a pair of cavities which define thumb holds positioned longitudinally outwardly of said transverse hand holds respectively for picking up the block by a person.

10. A malleable member for interlockingly and tightly inserting between two supporting parts to form a masonry block such that surfaces of the member engage surfaces respectively of the supporting parts over a height, wherein each of said member surfaces has a contour which in plan view of the member is defined by a line of contour and consists essentially of at least one first surface portion and at least one second surface portion, wherein said at least one first surface portion is susceptible to binding and comprises means including a plurality of spaced grooves in said at least one first surface portion which extend over said height for preventing binding, whereby the member when inserted between the supporting parts engages each supporting part over said respective first surface portion along said respective line of contour, and wherein said at least one second surface portion consists essentially of a multitude of spaced curved convex portions each extending over said height and alternating with a multitude of spaced recesses which recesses together define in the plan view a portion of said respective line of contour over said respective at least one second surface portion, whereby said curved convex portions in the plan view project from said respective line of contour so that only said curved convex portions engage the respective supporting part surface along said respective at least one second surface portion and over said height to thereby accommodate gradual enlargement over time of successive supporting parts due to mold wear.

11. A malleable member according to claim 10 wherein said grooves are rectilinear.

12. A malleable member according to claim 10 wherein said curved convex portions are semi-cylindrical.

13. A malleable member according to claim 10 wherein the malleable member is composed of insulation material.

14. A masonry block having two opposite and parallel sidewalls each having a length and two opposite and parallel ends, said sidewalls and said ends being generally perpendicular to each other, the masonry block comprising two spaced supporting parts extending along the length of the masonry block sidewalls so that each said supporting part defines a corresponding one of the masonry block sidewalls, each of said supporting parts having an inner surface defining a side of the space between said supporting parts, an insulating malleable member positioned within and substantially filling the space between said supporting parts and having a pair of surfaces which engage said supporting part inner surfaces respectively over a height, said supporting part inner surfaces and said insulating malleable member surfaces shaped to interlockingly engage said insulating malleable member to said supporting parts, and wherein each of said insulating malleable member surfaces has a contour which in plan view of said member is defined by a line of contour and consists essentially of over at least a major portion thereof a multitude of spaced curved convex portions each extending over said height and alternating with a multitude of spaced recesses which recesses together define a portion of said line of contour over said major portion, whereby said curved convex portions project from said line of contour so that only said curved convex portions engage said respective supporting part surface along said respective major surface portion and over said height to thereby accommodate gradual enlargement over time of successive supporting parts due to mold wear.

15. A masonry block according to claim 14 further comprising means for preventing binding of said member, wherein said means for preventing binding comprises at least one other portion of each of said member surfaces which is formed to engage said respective supporting part surface over said height and which has a plurality of spaced grooves therein which extend over said height, whereby said member engages said respective supporting part over said respective other surface portion and over said height along said respective line of contour.

16. A masonry block according to claim 15 wherein said grooves are rectilinear.

17. A masonry block according to claim 14 wherein said curved convex portions are semi-cylindrical.

18. A masonry block according to claim 14 further comprising means including an expanding foam sealant applied to said insulating malleable member for facilitating waterproofing of a wall constructed with the block.

19. A masonry block having two opposite and parallel sidewalls each having a length and two opposite and parallel ends, said sidewalls and said ends being generally perpendicular to each other, the masonry block comprising two spaced supporting parts extending along the length of the masonry block sidewalls so that each said supporting part defines a corresponding one of the masonry block sidewalls, each of said supporting parts having an inner surface defining a side of the space between said supporting parts, an insulating malleable member positioned within and substantially filling the space between said supporting parts and having a pair of surfaces which engage said supporting part inner surfaces respectively over a height between a lower surface and an upper surface, said supporting part inner surfaces and said insulating malleable member surfaces shaped to interlocking engage said insulating malleable member to said supporting parts, and wherein said insulating malleable member has, when positioned between said supporting parts, in said upper surface means for picking up the block, said picking up means including a pair of spaced transverse cavities in said upper surface which define hand holds for picking up the block by a person, a centrally positioned longitudinal cavity in said upper surface which defines a hand hold for picking up the block by a person, and a pair of circular cavities in said upper surface which define thumb holds for picking up the block by a person, wherein said thumb holds are positioned longitudinally outwardly of said transverse hand holds respectively, wherein all of said holds are located within said malleable member and between said pair of surfaces of said malleable member and wherein each of said member surfaces has a contour which in plan view of said member is defined by a line of contour and consists essentially of at least one first surface portion and at least one second surface portion, wherein said first surface portion consists essentially of a multitude of spaced curved convex surface portions each extending over said height and alternating with a multitude of spaced recesses which recesses together define a portion of said respective line of contour over said respective first surface portion whereby said curved convex portions project from said respective line of contour so that only said curved convex portions engage said respective supporting part surface along said first surface portion and over said height, and wherein said at least one second surface portion of each of said member surfaces is formed to engage said respective supporting part surface over said height and which has a plurality of spaced grooves therein which extend over said height, whereby said member engages said respective supporting part over said second surface portion and over said height along said line of contour.

* * * * *